US006044870A

United States Patent [19]

Speich

[11] Patent Number: 6,044,870

[45] Date of Patent: Apr. 4, 2000

[54] WEAVING REED AND GRIPPER GUIDE ELEMENT FOR A LOOM

[75] Inventor: Francisco Speich, Gipf-Oberfrick, Switzerland

[73] Assignee: Textilma AG, Hergiswil, Switzerland

[21] Appl. No.: 08/945,050

[22] PCT Filed: Mar. 6, 1996

[86] PCT No.: PCT/CH96/00077

§ 371 Date: Mar. 2, 1998

§ 102(e) Date: Mar. 2, 1998

[87] PCT Pub. No.: WO96/33304

PCT Pub. Date: Oct. 24, 1996

[30] Foreign Application Priority Data

Apr. 18, 1995 [DE] Germany ..... 295 06 561 U

[51] Int. Cl.[7] ..... D03D 49/62; D03D 47/27; D03D 49/60

[52] U.S. Cl. ..... 139/192; 139/449

[58] Field of Search ..... 139/192, 449

[56] References Cited

U.S. PATENT DOCUMENTS

| | | | |
|---|---|---|---|
| Re. 35,400 | 12/1996 | Stacher et al. | 139/449 |
| 2,434,114 | 1/1948 | Lussardi | 139/192 |
| 2,833,315 | 5/1958 | Dunham . | |
| 4,569,376 | 2/1986 | Volland et al. | 139/435 |
| 5,092,374 | 3/1992 | Riolet et al. | 139/446 |
| 5,664,609 | 9/1997 | Herrlein et al. | 139/192 |

FOREIGN PATENT DOCUMENTS

| | | |
|---|---|---|
| 2513667 | 4/1983 | France . |
| 2547602 | 12/1984 | France . |
| 3421638 | 12/1984 | Germany . |
| 9100753 | 7/1992 | Germany . |
| 2037330 | 7/1980 | United Kingdom . |
| 2043717 | 10/1980 | United Kingdom . |
| 2265160 | 9/1993 | United Kingdom . |

*Primary Examiner*—Andy Falik
*Attorney, Agent, or Firm*—Friedrich Kueffner

[57] ABSTRACT

A weaving machine includes a device for forming a shed from warp threads, a weft thread insertion unit for the insertion of a weft thread into the shed, guide elements for the weft thread insertion unit, wherein the guide elements can move into and out of the shed, and a weaving reed containing weaving reed dents for beating up an inserted weft thread at the knock-off of a woven fabric to be produced. One of the guide elements is associated with each corresponding weaving reed dent after two or more weaving reed dent pitches so as to extend in the same plane as the center plane of the weaving reed dent, wherein the center plane extends in the movement direction of the guide element, and wherein a deflecting member for the warp thread is arranged between the weaving reed dent and the guide elements, wherein the deflecting member widens out on either side of the center plane in the direction of the weft thread pattern and is formed integral with the weaving reed dent, and wherein the defecting member extends, starting from the bottom, to below the knock-off line of the weaving reed.

12 Claims, 5 Drawing Sheets

FIG. 12
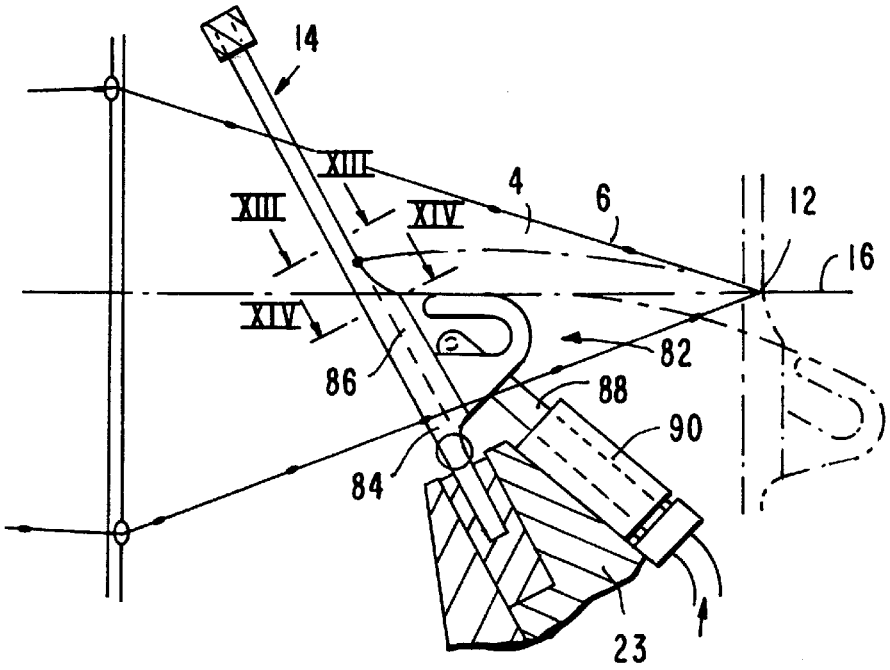
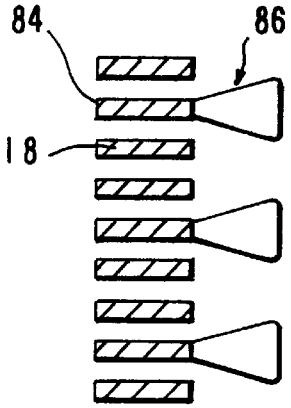
FIG. 13
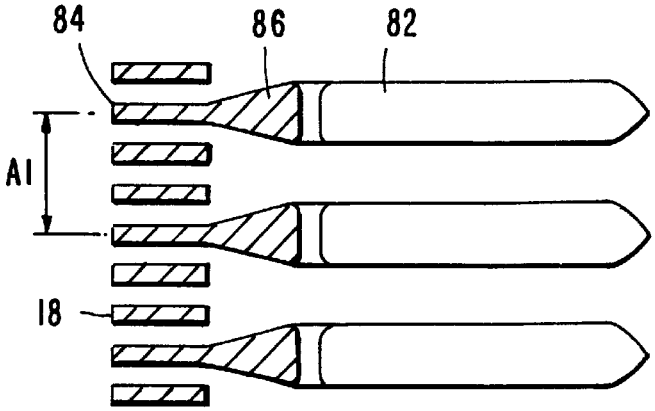
FIG. 14

WEAVING REED AND GRIPPER GUIDE ELEMENT FOR A LOOM

BACKGROUND OF THE INVENTION

1. Field of the Invention

The invention is directed to a weaving machine with a device for forming a shed from work threads, with weft thread insertion means for the insertion of a weft thread into the shed with guide elements for the weft thread insertion means, wherein the guide elements can move into and out of the shed, and with a weaving reed containing weaving reed dents for beating up an inserted weft thread at the knock-off of a woven fabric to be produced.

The weft thread insertion means feature is understood and referred to herein in its broadest meaning, e.g., such means as projectiles, grippers, shuttle, air jet or other media for insertion of a weft thread into a shed formed of warp threads. A great number of such weft thread insertion means are likewise known.

2. Description of the Related Art

Weaving machines of the type mentioned above are often high-power weaving machines in which the weft thread insertion means move into and out of the shed. Guide elements are required for this purpose, wherein difficulties arise in the processing of warp threads formed of parallel yarns. Parallel yarns are formed of a plurality of (at least two) individual synthetic fibrils or fibers which extend parallel to one another with practically no twisting. To prevent the fibrils of these threads from coming apart, they are glued together by paste or size or are connected portion-by-portion by an air interlacing or intermingling process. Yarns that have been produced by air interlacing are called air-interlaced or air-entangled yarn. There is a tendency for the warp threads made from such parallel yarns to split up at the guide elements, resulting in fibril breakage and/or thread breakage. This drastically reduces the efficiency of such high-power weaving machines, so that, ultimately, rather than such parallel yarns, only expensive twisted yarns can be used in these machines. In order to remedy this somewhat, such parallel yarns are additionally provided with a paste or size. Apart from the fact that such sizing processes are expensive, the size causes very extensive soiling of the weaving machines. Further, the size must be washed out during further processing of the woven fabric. The washed out size must be disposed of in an environmentally sound manner by a very cost-intensive process.

A shuttleless weaving machine is known from FR-A-2 547 602, wherein, in order to avoid the above-mentioned disadvantages, guide elements are formed at every reed dent to form an insertion channel in order that a weft thread can be introduced by means of air jets. However, this cannot prevent the risk of warp threads of untwisted yarn remaining suspended at the blowing nozzles or air jet nozzles, because these nozzles are wider than the spacing between the reed dents and accordingly than the spacing between the warp threads, and the latter are forced apart by the air jet nozzles during the swiveling of the weaving reed. Since the thickness of the guide elements only corresponds to the thickness of the reed dent, the guide elements are very thin and do not have sufficient stability and can bend, thereby increasing the risk that parts of the warp thread will remain suspended. They are not at all suitable for guiding the weft insertion members. In order to achieve adequate stability, the reed dents, and accordingly the guide elements, would have to be thicker, so that only a very coarse pitch of the weaving reed dents would be possible and only a correspondingly coarse woven fabric could be manufactured.

DE-U-91 00 753 discloses a weaving machine in which the weaving reed is provided with a shuttle guide whose going-parts having sliding elements which extend in the direction of the warp threads and engage between the warp threads. The sliding elements are wider than the warp thread spacing. In front of or behind every sliding element, there is arranged a displacing element which has at least the same width as the sliding element, but has a greater height than the sliding element and forms a dent bar or gap between the warp threads. The displacing element forms a point at the free end. The displacing element must force the warp threads apart with every change of shed to form a gap. This shuttle guide can not overcome the problems described above because it is suitable only for high-quality twisted yarns, but not for parallel yarns which would be damaged or destroyed at the pointed displacing element.

SUMMARY OF THE INVENTION

The object of the invention is to develop a weaving machine of the type mentioned above in such a way that parallel yarns can also be processed, even if they are not provided with size, wherein the disadvantages indicated above are avoided.

In accordance with the present invention, one of the guide elements is associated with each corresponding weaving reed dents after two or more weaving reed dent pitches so as to extend in the same plane as the center plane of the weaving reed dent, wherein the center plane extends in the movement direction, and wherein a deflecting member for the warp thread widens out on either side of the center plane in the direction of the weft thread pattern and is formed integral with the weaving reed dent. The deflecting member for the warp thread is arranged between the weaving reed dent and the guide elements, wherein the deflecting member extends, starting from a bottom, to below the knock-off line of the weaving reed.

Due to the fact that the deflecting member is formed integral with the weaving reed dent, the deflection of the warp threads required for the guide element for the weft thread insertion means, which guide element follows the weaving reed, is effected directly at the weaving reed, so that damage to the warp threads or destruction of the warp threads is prevented. The arrangement of guide elements, and accordingly also deflecting members, after two or more weaving reed dent divisions ensures a sufficient lateral spacing such that the guide elements for different weft thread insertion systems are constructed so as to be sufficiently stable and/or in order to select a fine weaving reed dent pitch. Accordingly, it is possible also to process parallel yarns in modern high-power weaving machines even when these yarns are not provided with size. This means that parallel yarns which are inexpensive to produce can be processed and this can be done on fast high-power weaving machines. Moreover, it is no longer necessary to subsequently wash out size which is now absent. The cost advantages resulting from this are obvious.

The deflecting member preferably extends, below the upper side of the guide element, but preferably below the shed when the weaving reed is located in the position furthest from the knock-off of the woven fabric.

In accordance with advantageous features, the greatest width of the deflecting member corresponds at most to ten times the pitch of the weaving reed and the length of the deflecting member in the movement direction of the weaving reed amounts to at least half of the thickness of the weaving reed dent.

The deflection of the warp threads is improved when the deflecting member has a reduced diameter toward the knock-off line of the weaving reed.

The guide element is advantageously arranged independent from the weaving reed dent. A construction of this kind can be effected by constructing the deflecting member as a thickening of the weaving reed dent. A simpler and easier construction is obtained if the weaving reed is formed of parts which are arranged in a mirror-inverted manner with respect to the center plane, wherein the parts have angled edge areas for forming the deflecting member. The parts are preferably sheet-metal parts.

A weaving reed dent having the integrated guide element can be connected directly with the weaving reed. In many cases, however, can also be advantageous if the weaving reed dent having the integrated guide elements is not connected with the weaving reed, but is connected with a device supporting the guide element. However, it is also possible for the guide element to be constructed in two parts and for one guide element part to be arranged at the weaving reed dent and the other to be arranged at a separate carrier.

BRIEF DESCRIPTION OF THE DRAWINGS

Embodiment examples of the weaving machine according to the invention are explained more fully hereinafter with reference to schematic drawings, wherein only those parts of the shed area of the weaving machine, which are relevant for the present configuration according to the invention are shown.

FIG. 12 shows a side view of the weaving area of a fifth weaving machine;

FIG. 13 shows the weaving reed with deflecting members in section XIII—XIII of FIG. 12 in enlarged scale; and FIG. 14 shows the weaving reed with deflecting members and with guide elements in section XIV—XIV of FIG. 12 in enlarged scale.

DESCRIPTION OF THE PREFERRED EMBODIMENTS

Identical structural component parts are provided with identical reference numbers in the following embodiment examples and Figures.

Figure 1:
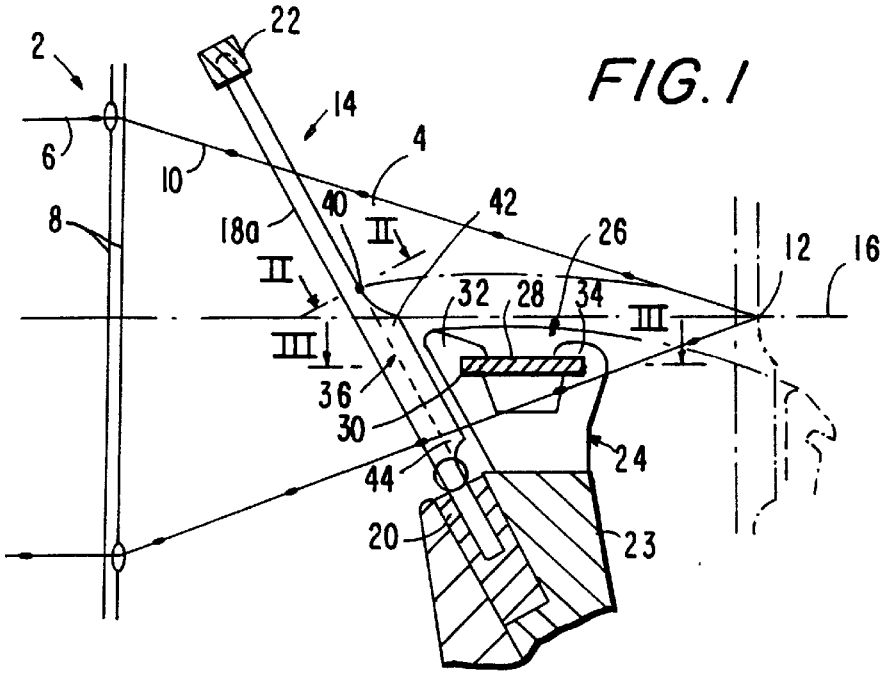
FIG. 1 is a side view of the weaving area of a first weaving machine.

FIG. 1 shows the weaving area of a first weaving machine which has a device 2 for forming a shed 4 from warp threads 6. All that is shown of the device 2 for forming the shed are heddles 8 which move the warp thread up and down and accordingly open, close and change the shed. The warp threads 6 are made, for example, from parallel yarns which are produced by the air-interlacing process and contain interlacing points as knots 10. The warp threads 6 are guided together at the knock-off 12 at which a weft thread, not shown, which is inserted into the shed 4 by means of a weaving reed 14, is beaten up and thus serves to produce the woven fabric 16. The weaving reed 14 comprises individual weaving reed dents 18 which are arranged in a weaving reed pitch T in a lower carrier 20 and are connected with one another at the upper end by a binder rod 22. The weaving reed is securely clamped in at the reed lever 23. Further, guide elements 24 are arranged at the reed lever 23 and serve to guide the weft thread insertion means 26 which, in the present case, have an insertion band 28 which is guided between two groove-like recesses 30 in teeth 32, 34 of the guide element 24. The guide element 24 is arranged so as to extend in the same plane as the center plane M of an associated weaving reed dent 18*a*, which center plane M extends in the movement direction, as is shown especially in FIG. 3. Between the weaving reed dent 18*a* and the guide element 24, there is a deflecting member 16 which is formed integral with the weaving reed dent 18*a*. The deflecting member for the warp threads 6 widens out on either side of the center plane M in the direction 38 of the weft thread pattern, so that it forms, starting from the weaving reed dent 18*a*, a wedge-shaped guide for the weft threads and moves the latter laterally past the guide elements 24 without there being a risk that the warp threads remain suspended at the guide elements 24.

The deflecting member 36 begins below a knock-off line 40 of the weaving reed 14 and extends at least over the upper side of the associated guide element 24, but preferably farther down until it projects from the shed 4 as is shown in FIG. 1. At the top and bottom, the deflecting member 36 is provided with portions 42, 44 which are tapered or reduced in diameter to facilitate the deflection of the warp threads when moving into and out of the shed. In the knock-off position of the weaving reed shown in dash-dot lines in FIG. 1, the deflecting member lies below the knock-off.

The deflecting member is preferably so constructed that the greatest width B of the deflecting member corresponds at most to ten times the pitch T of the weaving reed dent. The length L of the deflecting member in the movement direction of the weaving reed 14 is at least half of the thickness d of the weaving reed dent 18*a*. In the shown example, the spacing A between adjacent deflecting members 36 corresponds to twice the pitch T of the weaving reed dents 18.

Figure 3:
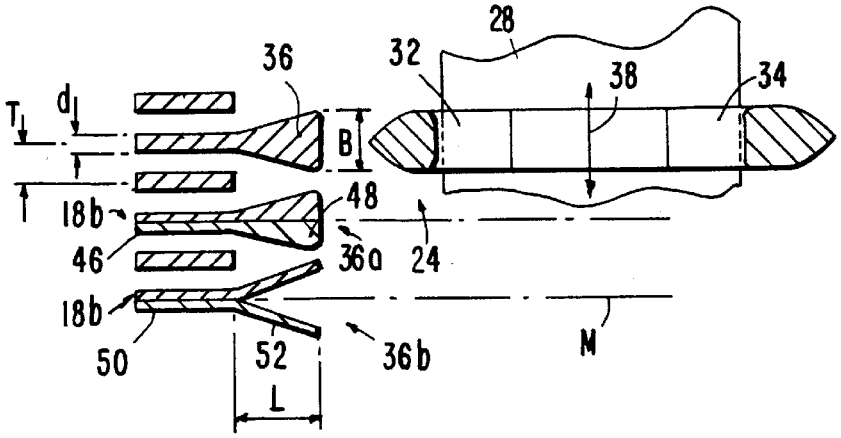
FIG. 3 shows the weaving reed with deflecting members and guide element in section III—III of FIG. 1 in enlarged scale.
Figure 4:
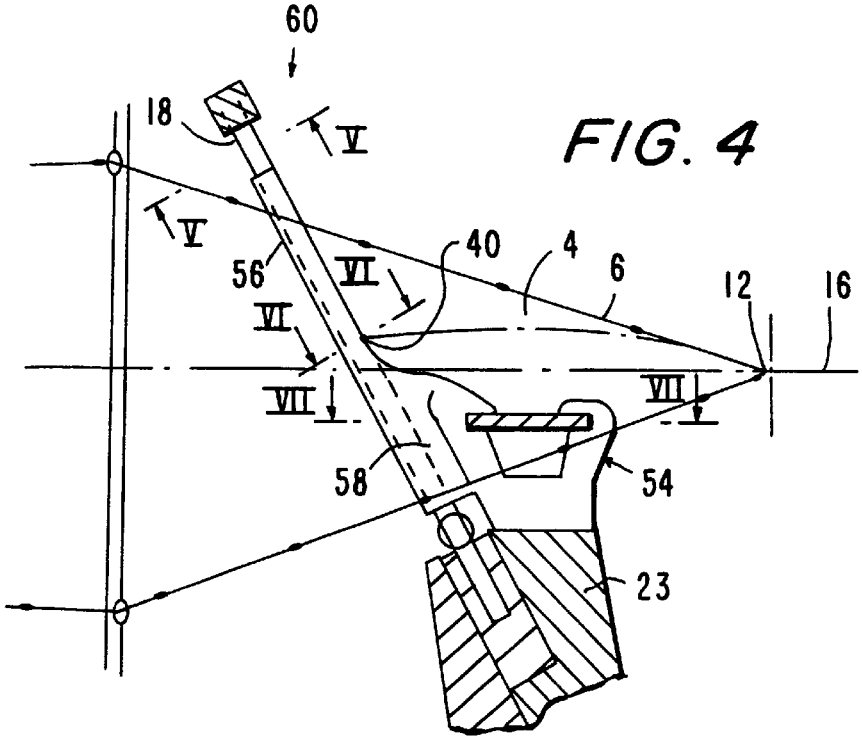
FIG. 4 shows a side view of the weaving area of a second weaving machine.

Further constructions of the deflecting member 36 are shown in FIG. 3. Accordingly, the weaving reed dent 18*b* is formed of two parts 46 which are arranged along the center plane M in a mirror-inverted manner and have thickened portions 48 forming the deflecting member 36*a*. The weaving reed dent 18*b* is likewise divided along the center plane M and constructed in a mirror-inverted manner. The individual parts 50 are formed of sheet metal and the deflecting members 36*b* are formed by angled edge areas 52.

Figure 2:
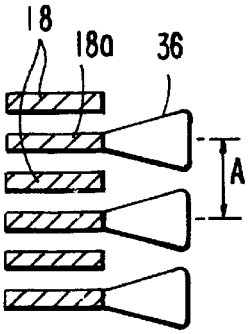
FIG. 2 shows the weaving reed with deflecting members in section II—II of FIG. 1 in enlarged scale.

FIGS. 4 to 7 show the weaving area of another weaving machine which is identical to the weaving machine in FIGS. 1 to 3 with respect to the weft thread insertion means 36. However, in this case, the area between the weaving reed dent 56 and the guide element 54 is constructed as a deflecting member 58. Further, the weaving reed dent 56 is not connected with the weaving reed 60, but rather is carried by the guide element 54 and fastened at the reed lever 23.

Figure 8:
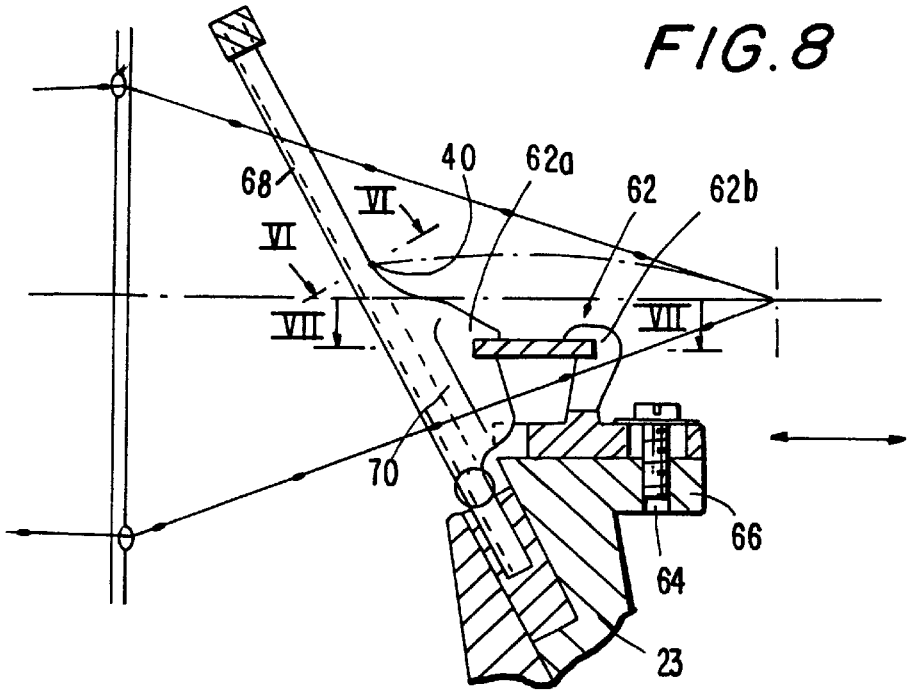
FIG. 8 shows a side view of the weaving area of a third weaving machine.
Figure 5:
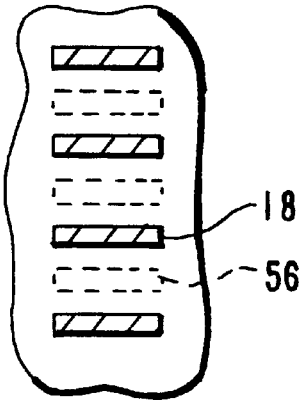
FIG. 5 shows the weaving reed in section V—V of FIG. 4 in enlarged scale.
Figure 6:
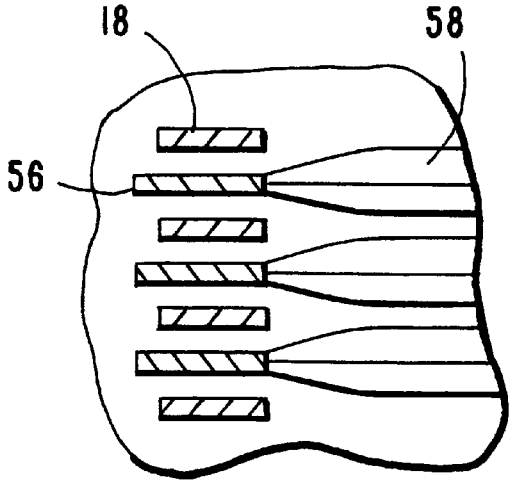
FIG. 6 shows the weaving reed with deflecting members in section VI—VI of FIG. 4 in enlarged scale.
Figure 7:
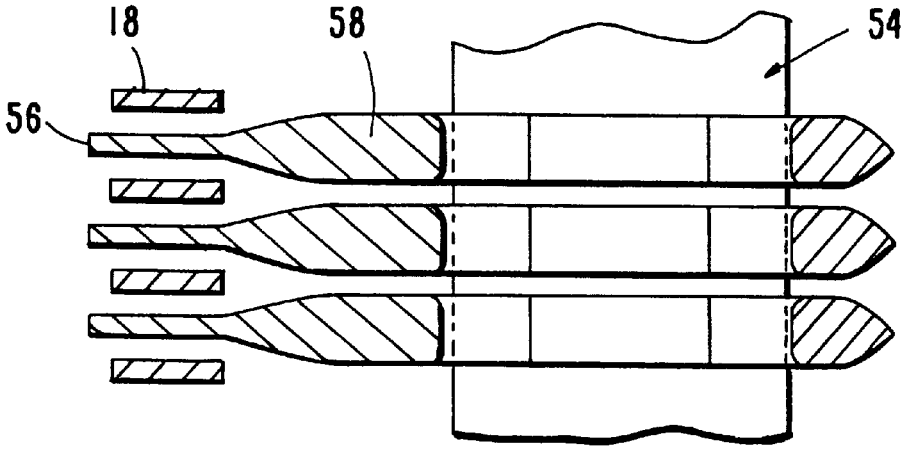
FIG. 7 shows the weaving reed with deflecting member and with guide elements in section VII—VII of FIG. 4 in enlarged scale.

FIG. 8 shows a mixture of the embodiment examples of FIGS. 1 to 3 and 4 to 7, wherein the guide element 62 is divided into guide element parts 62*a*, 62*b*. The guide element part 62*b* is connected, via a screw 64, with a separate carrier 66 which is, in turn, fastened to the reed lever 23 of the weaving reed. The other guide element part 62*a* forms an integral component part of the weaving reed dent 68, wherein the deflecting member 70 is again arranged between the guide element part 62*a* and the weaving reed dent 68.

Figure 9:
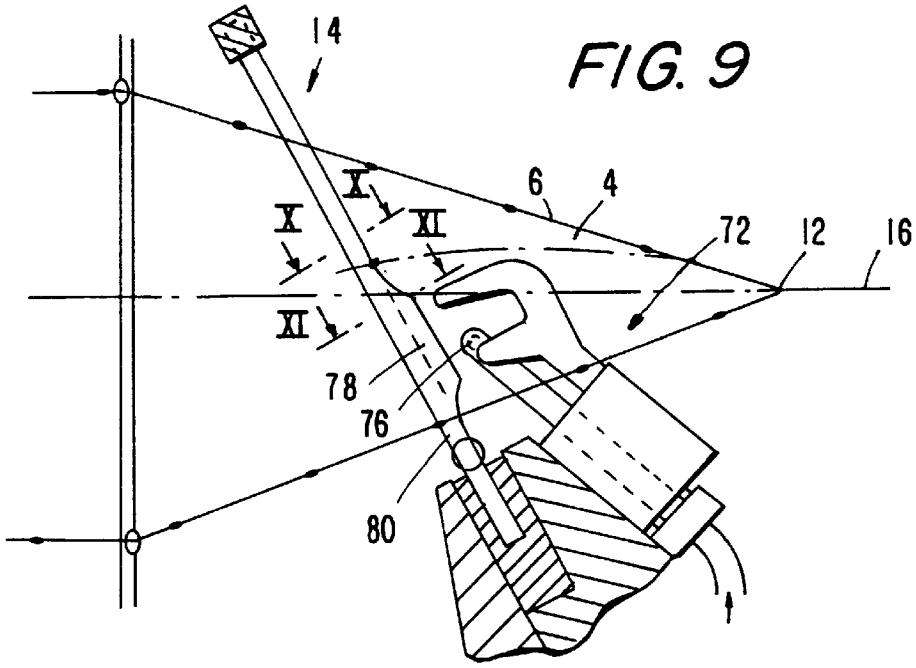
FIG. 9 shows a side view of the weaving area of a fourth weaving machine; p
Figure 10:
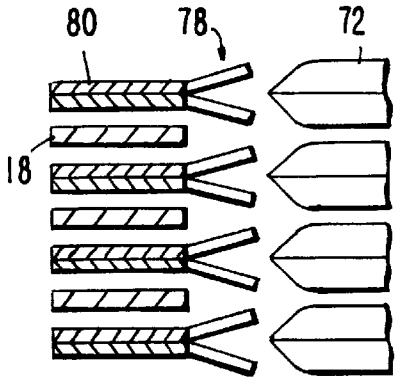
FIG. 10 shows the weaving reed with deflecting members and with guide elements in section X—X of FIG. 9 in enlarged scale.
Figure 11:
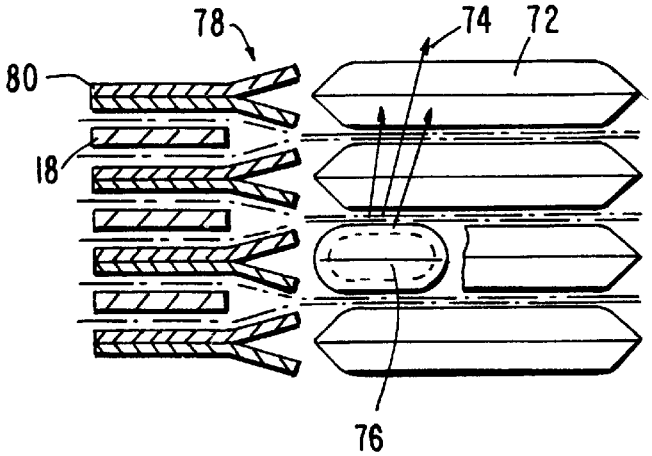
FIG. 11 shows the weaving reed with deflecting members and with guide elements in section XI—XI of FIG. 9 in enlarged scale.

FIGS. 9 to 11 show the weaving area of another weaving machine, wherein the guide elements 72 are so constructed that they use an air jet 74 as weft thread insertion means, this air jet 74 being blown into the guide elements 72 from stepped nozzles 76. Deflecting members 78 associated with the guide elements 72 are formed integral with the associated weaving reed dent 80, namely in a manner analogous to the deflecting member 36*b* shown in FIG. 3.

FIGS. 12 to 14 show the weaving area of another weaving machine which is constructed in a manner similar to that shown in FIGS. 9 to 11; however, in FIGS. 12 to 14, the guide elements 82 mare formed integral with a weaving reed dent 84 and the deflecting members 86 are formed between the weaving reed dent 84 and the guide element 82. The stepped nozzles 88 serving to blow in air are fastened to a carrier 90 which is fastened in turn to the reed lever 23 of the weaving reed 14. In the shown example, the spacing A1 between adjacent guide elements 82 and the corresponding weaving reed dents 84 corresponds to three times the pitch T of the weaving reed dents 84 of the weaving reed 14.

I claim:

1. Weaving machine comprising a device (2) for forming a shed (4) from warp threads (6), weft thread insertion means (26) for the insertion of a weft thread into the shed (4) in accordance with a weft thread pattern, guide elements (24, 54, 62, 62*a*, 62*b*, 72, 82) for the weft thread insertion means (26), which guide elements (24, 54, 62, 62*a*, 62*b*, 72, 82) are displaceable into and out of the shed (4) from below the shed, and a weaving reed containing weaving reed dents (18, 18*a*, 18*b*, 56, 68, 80, 84) for beating up an inserted weft thread at the knock-off (12) of a woven fabric (16) to be produced, wherein one of the guide elements (24, 54, 62, 62*a*, 62*b*, 72, 82) is associated with each corresponding weaving reed dent (18, 18*a*, 18*b*, 56, 68, 80, 84) after two or more weaving reed dent pitches (T) so as to extend in the same plane as the center plane (M) of the weaving reed dent (18, 18*a*, 18*b*, 56, 68, 80, 84), which center plane (M) extends in a movement direction of the guide element, wherein a deflecting member (36, 36*a*, 36*b*, 58, 70, 78, 86) for the warp thread (6) widens out on either side of the center plane (M) in the direction (38) of the weft thread pattern and is formed integral with the weaving reed dent, is arranged between the weaving reed dent and the guide elements (24, 54, 62, 62*a*, 62*b*, 72, 82), wherein the deflecting member extends, starting from a bottom, to below the knock-off line (40) of the weaving reed (14, 60).

2. Weaving machine according to claim 1, wherein the deflecting member (36, 36*a*, 36*b*, 58, 70, 78, 86) extends at least to below an upper side of the guide element (24, 54, 62, 62*a*, 62*b*, 72, 82) and to below the shed (4) when the weaving reed (14, 60) is located in the position farthest from the knock-off (12) of the woven fabric (16).

3. Weaving machine according to claim 1, wherein the greatest width (B) of the deflecting member (36, 36*a*, 36*b*, 58, 70, 78, 86) corresponds at most to ten times the pitch (T) of the weaving reed (14, 60).

4. Weaving machine according to claim 1, wherein the length (L) of the deflecting member (36, 36*a*, 36*b*, 58, 70, 78, 86) in the movement direction of the weaving reed (14, 60) amounts to at least half of the thickness (d) of the weaving reed dent (18, 18*a*, 18*b*, 56, 68, 80, 84).

5. Weaving machine according to claim 1, wherein the deflecting member (36, 36*a*, 36*b*, 58, 70, 78, 86) has a reduced diameter toward the knock-off line (40) of the weaving reed (14, 60).

6. Weaving machine according to claim 1, wherein the guide element (24, 72) is arranged independently from the weaving reed dent (18, 18*a*, 18*b*, 80).

7. Weaving machine according to claim 1, wherein the deflecting member (36, 36*a*, 36*b*, 58, 86) is constructed as a thickening (48) of the weaving reed dent (18, 18*a*, 18*b*, 56, 84).

8. Weaving machine according to claim 1, wherein the weaving reed (14) is formed of parts (46, 50) which are arranged in a mirror-inverted manner with respect to the center plane (M) which parts have angled edge areas (5) for forming the deflecting member (36*b*).

9. Weaving machine according to claim 8, wherein the weaving reed is formed of sheet-metal parts.

10. Weaving machine according to claim 1, wherein said guide elements include at least one integrated guide element and wherein at least one weaving reed dent (68, 84) is associated with at least one integrated guide element (62*a*, 82), said at least one weaving reed dent being connected with the weaving reed (60).

11. Weaving machine according to claim 10, wherein said guide elements include at least one guide element (62) being constructed in two parts, said two guide element parts including a first guide element part (62*a*) being arranged at the weaving reed dent (68) and a second guide element part (62*b*) being arranged at a separate carrier (66).

12. Weaving machine according to claim 1, wherein said guide elements include at least one integrated guide element and wherein at least one weaving reed dent (56) is associated with at least one integrated guide element (54), said at least one weaving reed dent being connected not with the weaving reed (14) but instead with a device (20) supporting at least one integrated guide element (54).

* * * * *